US006975204B1

(12) United States Patent
Silver

(10) Patent No.: US 6,975,204 B1
(45) Date of Patent: Dec. 13, 2005

(54) METHOD AND APPARATUS FOR PREVENTING UNAUTHORIZED USE OF EQUIPMENT

(75) Inventor: Alan G. Silver, Allen, TX (US)

(73) Assignee: Raytheon Company, Waltham, MA (US)

( * ) Notice: Subject to any disclaimer, the term of this patent is extended or adjusted under 35 U.S.C. 154(b) by 411 days.

(21) Appl. No.: 10/193,537

(22) Filed: Jul. 11, 2002

(51) Int. Cl.[7] ..... G05B 19/00; F41A 17/00; G06F 11/30

(52) U.S. Cl. ..... 340/5.31; 340/5.61; 72/70.11; 713/194

(58) Field of Search ..... 340/5.31, 426.11, 340/426.12, 572.3, 5.61; 42/70.11; 713/194, 713/201

(56) References Cited

U.S. PATENT DOCUMENTS

| | | | | |
|---|---|---|---|---|
| 4,818,998 A | | 4/1989 | Apsell et al. | |
| 4,908,629 A | | 3/1990 | Apsell et al. | |
| 5,229,541 A | | 7/1993 | Will et al. | |
| 5,307,048 A | * | 4/1994 | Sonders | 340/5.31 |
| 5,448,847 A | * | 9/1995 | Teetzel | 42/70.11 |
| 5,469,557 A | * | 11/1995 | Salt et al. | 713/194 |
| 5,748,084 A | * | 5/1998 | Isikoff | 340/5.74 |
| 5,917,423 A | | 6/1999 | Duvall | |
| 6,223,461 B1 | * | 5/2001 | Mardirossian | 42/70.11 |
| 6,300,863 B1 | | 10/2001 | Cotichini et al. | |
| 6,337,620 B1 | | 1/2002 | Chen | |
| 6,363,854 B1 | | 4/2002 | Schweitzer | |
| 6,725,379 B1 | * | 4/2004 | Dailey | 713/201 |
| 2002/0149468 A1 | * | 10/2002 | Carrender et al. | 340/5.31 |
| 2003/0110972 A1 | | 6/2003 | Porter, Jr. | |

FOREIGN PATENT DOCUMENTS

| | | |
|---|---|---|
| DE | 35 15 703 C1 | 5/1996 |
| GB | 2 299 850 A | 10/1996 |
| WO | WO 00/63636 | 12/2000 |

* cited by examiner

*Primary Examiner*—Brian Zimmerman
*Assistant Examiner*—Clara Yang
(74) *Attorney, Agent, or Firm*—Baker Botts L.L.P.

(57) ABSTRACT

An apparatus includes a device which is capable of performing a function, and which is responsive to receipt of a predetermined wireless signal for nondestructively rendering itself incapable of thereafter performing the function. In one form of the invention, the capability of the device to perform the function can be restored by the occurrence of a secure event originating externally of the device. In a different form of the invention, the device includes a memory, and information stored in the memory is erased in order to render the device incapable of performing the function.

34 Claims, 2 Drawing Sheets

METHOD AND APPARATUS FOR PREVENTING UNAUTHORIZED USE OF EQUIPMENT

BACKGROUND OF THE INVENTION

Efforts are made to keep certain equipment such as sophisticated military weapons out of the hands of unauthorized users, including terrorists and military adversaries. Nevertheless, these weapons and equipment sometimes do come to be in hostile control. This may occur through theft, or through unauthorized sale. Alternatively, weapons or equipment may be sold to a foreign nation at a time when the nation is considered to be an ally, but that nation may subsequently come to be considered an adversary, for example due to a coup or some other internal political shift. Still another consideration is that it is sometimes difficult to determine who will actually be the true and ultimate recipient of weapons or equipment that are involved in a particular sale.

The fact that equipment or a weapon is present in hostile hands is a problem, not only when it is known that the particular weapon or item of equipment is in hostile hands, but also when it not yet known that the equipment or weapon has passed into hostile hands. Traditional attempts to avoid this type of problem have included strict export restrictions regarding which weapons and equipment can be exported or sold, and to whom. While these export restrictions have been helpful to some degree, they have not been satisfactory in all respects.

SUMMARY OF THE INVENTION

From the foregoing, it may be appreciated a need has arisen for a method and apparatus for limiting unauthorized or undesirable use of weapons or equipment. According to the present invention, a method and apparatus are provided to address this need, and involve operating a device capable of performing a function so that, in response to receipt by the device of a predetermined wireless signal, the device is rendered incapable of thereafter performing the function. According to one form of the invention, the capability of the device to perform the function can be restored in response to the subsequent occurrence of a secure event originating externally of the device. According to a different form of the invention, information is stored in a memory, a processor helps perform the function in dependence on the information in the memory, and the information is erased from the memory in order to render the device incapable of performing the function.

BRIEF DESCRIPTION OF THE DRAWINGS

A better understanding of the present invention will be realized from the detailed description which follows, taken in conjunction with the accompanying drawings, in which.

DETAILED DESCRIPTION OF THE INVENTION

Figure 1:
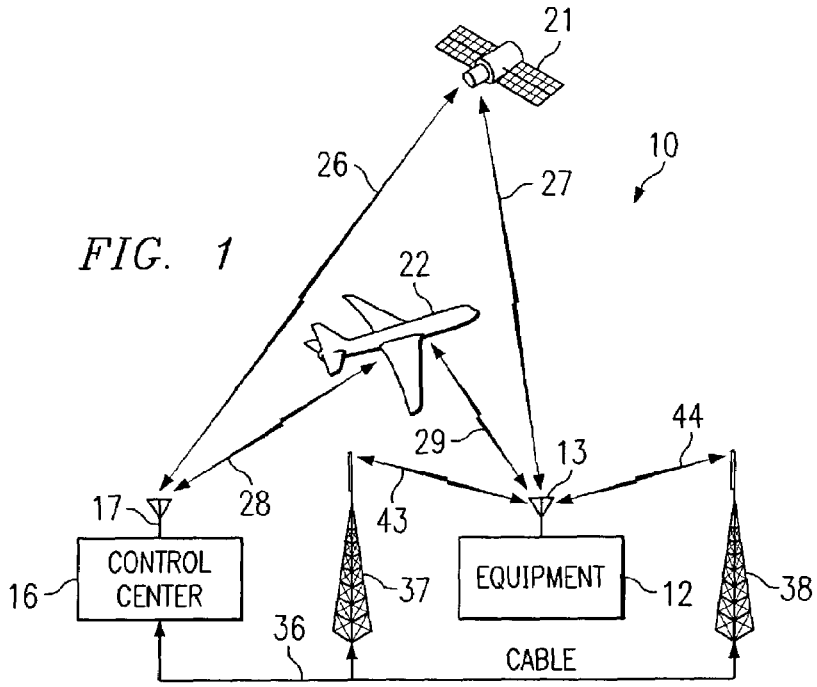
FIG. 1 is a block diagram of a system which embodies the invention and which permits an authority to remotely locate and/or disable equipment such as a military weapon.

FIG. 1 is a diagrammatic view of an apparatus which is a system 10 that embodies aspects of the present invention. The system 10 includes an item of equipment 12, which has an antenna 13. In the disclosed embodiment, the item of equipment 12 is a military weapon, such as a mobile rocket launcher of the type that can be manually carried, or a larger mobile rocket launcher of the type mounted on a vehicle. However, the present invention is not limited to a weapon and/or a military context, but could readily be utilized for a variety of different types of devices in a variety of other applications.

The system 10 further includes a control center 16, which has an antenna 17. In the disclosed embodiment, the control center 16 is a military headquarters. However, as noted above, the present invention is not limited to a military context, and the control center 16 could thus be part of a commercial entity, or some other form of entity.

The system 10 includes a satellite 21, and a high-altitude airplane 22, both of which serve as a relay for wireless signals being transmitted between the control center 16 and the equipment 12. In particular, as indicated diagrammatically by the broken lines at 26 and 27, the satellite 21 can relay wireless signals which are being transmitted between the control center 16 and the equipment 12. Similarly, as indicated diagrammatically by the broken lines at 28 and 29, the airplane 22 has equipment that can relay wireless signals which are being transmitted between the control center 16 and the equipment 12. For clarity, FIG. 1 shows a single satellite 21 and a single airplane 22, but the system 10 can include a plurality of satellites 21 and/or a plurality of airplanes 22, which each cover various different portions of the surface of the earth.

The system 10 includes a plurality of towers that support antennas, two of which are shown at 37 and 38 in FIG. 1. The antennas on these towers are operatively coupled to the control center 16 through a cable 36. However, the control center 16 could alternatively be coupled to the antennas on the towers 37 and 38 in some other manner, for example through wireless signals relayed through the satellite 21 and/or the airplane 22. Wireless signals can be transmitted between the equipment 12 and the antennas on each of the towers 37 and 38, for example as indicated diagrammatically by the broken lines at 43 and 44. Although not shown in the drawings, it would be possible to have a mobile ground unit with an antenna which was functionally comparable to the antennas on the towers 37 and 38, where the mobile ground unit would communicate with both the control center 16 and the equipment 12 through respective wireless transmissions.

Although the satellite 21, the airplane 22 and the towers 37 and 38 serve as respective parts of the system 10, they can simultaneously serve other functions. For example, the satellite 21 and the airplane 22 may each relay wireless signals for a different type of system with a different function, such as wireless signals that carry telecommunications information. Similarly, the towers 37 and 38 may also serve other functions, and may for example be part of a cellular telephone network.

At any given point in time, the equipment 12 may not be in a scenario where it is served by all types of wireless communication support. For example, since the equipment 12 is mobile, it may be moved to an undeveloped part of the globe where there is little or nothing in the way of land-based antennas like those supported by the towers 37 and 38, but where communication is possible through a satellite 21, and/or through a high-altitude airplane 22. As a different example, the equipment 12 could also be moved to a major urban area, where there are many land-based antennas of the type supported on the towers 37 and 38, and where there is service from a satellite such as that shown at 21, but where no airplane 22 is currently present.

FIG. 1 shows several ways in which wireless signals can be transmitted to or from the equipment 12, for example by way of the satellite 21, by way of the airplane 22, or by way of land-based antennas such as those on the towers 37 and 38. These various techniques are presented by way of example, and are not to be considered limiting. The invention contemplates that wireless signals could be transmitted to or from the equipment 12 in any other suitable manner.

Before describing certain aspects of the system 10 in detail, a brief overview of the operation of the system 10 will be provided in order to facilitate a better understanding of the details. More specifically, it is initially assumed that the equipment 12 is in the hands of a military adversary. This may be the result of a situation in which the equipment 12 was obtained by a terrorist or other adversary through proper or improper means. Alternatively, this may be the result of a situation in which the equipment was sold to a nation that was considered to be a friendly ally at the time of the sale, but that later came to be considered an adversary, for example due to political changes at the international level, or through a coup or other political upheaval within the foreign nation.

A first consideration is that it may be helpful to know the current location of the equipment 12. In fact, knowledge of the current location of the equipment 12 may be a significant factor in identifying a situation where the equipment 12 has come to be in the possession of an adversary. To this end, the equipment 12 is designed so that, when it is turned on, it automatically transmits a wireless signal containing a code that uniquely identifies the equipment. This transmission is encrypted, for example using encryption techniques of a known type, in order to prevent an adversary from generating wireless signal which emulate the wireless signals that are transmitted by the equipment 12.

This transmission can be used to determine the current location of the equipment 12. For example, where the signal is received by two or more different antennas at spaced locations, such as the antennas on the two towers 37 and 38 in FIG. 1, the location of the equipment can be determined through known triangulation techniques. Where the signal is received by only a single antenna, the location of the equipment can still be roughly determined on the basis of the transmission range of the equipment. In other words, if the equipment can transmit a signal a specified distance, then the equipment should be within circular region around the receiving antenna which has a radius equal to the specified distance. The location of the equipment can be determined to an accuracy of about 10 km, or better. The signal which the equipment 12 broadcasts at power-up can also serve as a trigger for the control center 16 to send that item of equipment any wireless messages destined for it that may have been queued up while its power was turned off.

After the equipment 12 has been turned on, the control center 16 can broadcast a wireless inquiry or interrogation signal through all available wireless paths, and the equipment 12 will then respond to each such interrogation signal by transmitting a wireless signal that is equivalent to the signal which it transmits when its power is turned on. Each time the equipment 12 transmits this wireless signal, the signal will be received through one or more wireless links and will be forwarded to the control center 16. The control center 16 can use this information not only to identify the equipment 12, but also to identify its location. If the control center does not receive a wireless signal from a particular item of equipment in response to several interrogation commands, an appropriate person or authority is notified.

Assuming a determination is made that the particular item of equipment 12 is now in the hands of an adversary, the control center 16 can send through any or all of the wireless paths in FIG. 1 a predetermined wireless signal which is encrypted and which causes the equipment 12 to disable selected functional capabilities (such as its capability to function as a weapon). These functional capabilities are disabled in a manner so that the equipment 12 cannot be restored to its normal operational capability without some external device or information which is controlled by the control center 16.

Thus, for example, control center 16 can use a predetermined and encrypted wireless signal to disable the capability of the equipment 12 to function as a weapon, and this capability cannot be restored unless the control center 16 decides to restore it, for example by transmitting a further encrypted signal containing information which the equipment 12 needs in order to restore its capability to function as a weapon. The wireless signals are appropriately encrypted, so that an adversary cannot generate these signals for purpose of disabling comparable equipment 12 which is still under control of the control center 16 and thus available for use against the adversary, or for the purpose of restoring the functional capability of a disabled weapon which is in the possession of the adversary.

To the extent that an adversary has possession of the equipment 12 under circumstances where the equipment 12 has not yet been disabled by the control center 16, there will be motivation for the adversary to try to tamper with the equipment 12 in a manner which prevents the equipment 12 from disabling itself in response to a wireless command from the control center 16. Accordingly, the equipment 12 has been designed to have the capability to detect tampering. In the event that the equipment 12 finds that tampering may have occurred, the equipment 12 automatically disables itself in essentially the same manner as if it had received a wireless command to disable itself, for example by disabling its capability to function as a weapon.

To this point, the present discussion of operation has been based on the assumption that the equipment 12 is in the possession of an adversary. It is alternatively appropriate to consider the situation where the equipment 12 is presently in friendly hands, rather than the hands of an adversary. In this regard, and as discussed above, the equipment 12 normally transmits an identification signal each time its power is turned on, and each time it subsequently receives an interrogation signal. However, if the equipment 12 is in friendly hands, and if it is being used for a mission or operation, wireless transmissions by the equipment 12 could be undesirable. In particular, wireless transmissions by the equipment 12 could be intercepted and evaluated by an adversary, thereby permitting the adversary to detect the presence of the equipment and identify its location, for example through triangulation, even if the adversary did not have the capability to decrypt the encrypted information which is embedded present in the wireless signal.

Detection of the presence and/or location of the equipment 12 would typically give away to an adversary the presence and/or position of the friendly soldiers or other persons who are using the equipment 12, which is obviously undesirable. Accordingly, where the equipment 12 is known to currently be in friendly hands, the control center 16 can send to a particular item of equipment 12 a wireless command which instructs that item of equipment 12 to cease all wireless transmissions, until such time as the equipment 12 receives a further wireless command which tells the equipment 12 to resume wireless transmissions. As an alternative to completely inhibiting the equipment 12 from transmitting any wireless signals, the equipment 12 could be provided with transmission hardware having a low probability of detection, such as a highly directional antenna.

Figure 2:
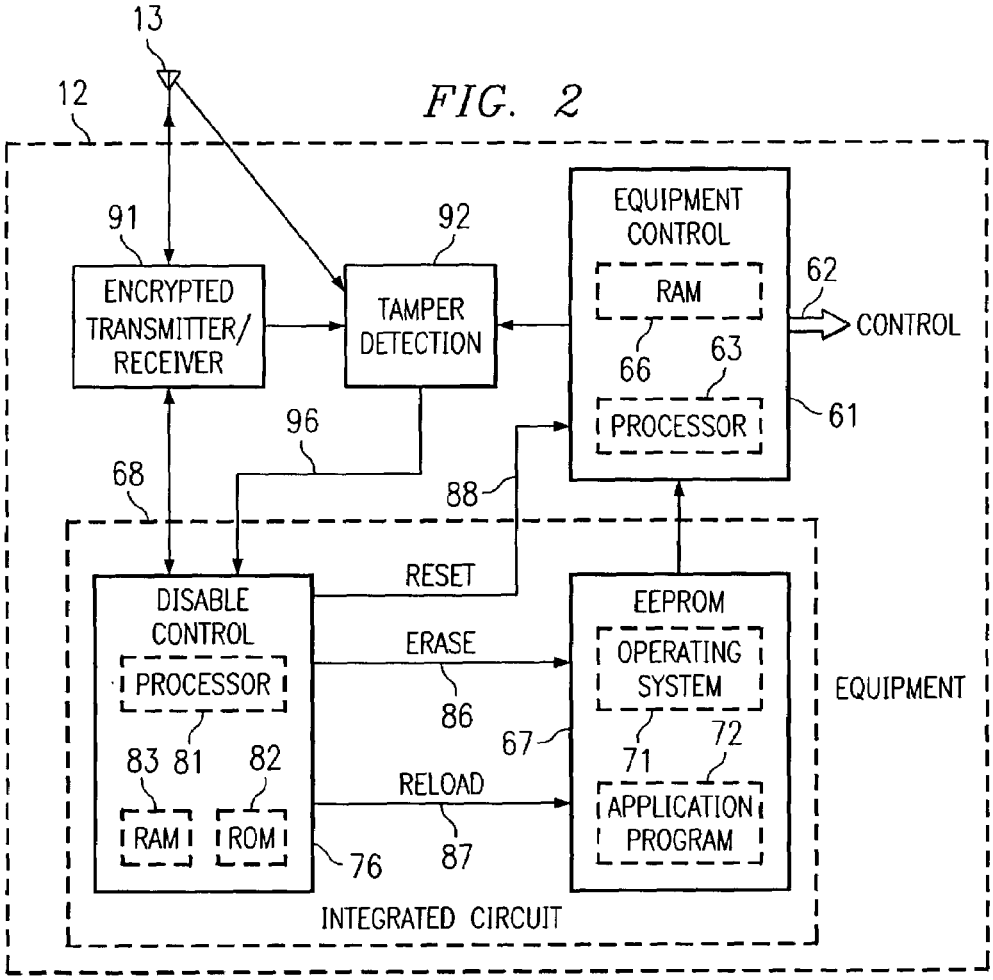
FIG. 2 is a block diagram showing additional detail regarding the internal structure of an item of equipment which is a component of the system of FIG. 1.

Turning now in more detail to the equipment 12, FIG. 2 is a block diagram showing relevant aspects of the internal configuration of the equipment 12. As shown in FIG. 2, the equipment 12 includes an equipment control circuit 61, which produces control signals 62 that control operational capabilities of the equipment 12. For example, where the equipment 12 is a mobile rocket launcher, the control signals 62 would include signals coupled to not-illustrated structure that controls the capability of the equipment 12 to effect the launch of a rocket. As shown in FIG. 2, the equipment control circuit 61 includes a processor 63 which is a known type of processor, and includes random access memory (RAM) 66 in which the processor 63 can store the software it is currently executing, as well as data which the processor 63 is manipulating under program control. The software executed by the processor 63 is stored in an electrically erasable programmable read only memory (EEPROM) 67, and after a reset, for example when power is turned on, the processor 63 copies the software from the EEPROM 67 to the RAM 66, and then executes the software from the RAM 66. The EEPROM 67 is embedded in an integrated circuit 68. In the disclosed embodiment, the information stored in the EEPROM 67 includes an operating system 71 and an application program 72, which are both copied to the RAM 66 and then executed by the processor 63.

The integrated circuit 68 includes not only the EEPROM 67, but also a disable control circuit 76. By providing both the disable control circuit 76 and the EEPROM 67 within a single integrated circuit, they cannot be easily separated for the purpose of circumventing security features of the equipment 12 which are discussed later. The disable control circuit 76 includes a processor 81, a read only memory (ROM) 82, and a RAM 83. At least one of the ROM 82 and RAM 83 is non-volatile memory, which can store information through a power outage. The processor 81 executes a program which is stored in the ROM 82, and uses the RAM 83 to store data that the processor 81 is manipulating under program control.

The disable control circuit 76 has the capability to selectively erase all or a part of the information stored in the EEPROM 67, as indicated diagrammatically at 86. The disable control circuit 76 also has the capability to load information into the EEPROM 67, as indicated diagrammatically at 87, for example to restore a portion of the information in EEPROM 67 which was previously erased. Moreover, the disable control circuit 76 has the capability to reset the equipment control circuit 61, including the processor 63 in the circuit 61, as indicated diagrammatically at 88. When the disable control circuit 76 resets the equipment control circuit 61, the processor 63 in the circuit 61 has to "reboot", which includes copying software that the processor 63 is to execute from the EEPROM 67 to the RAM 66.

The equipment 12 also includes a transmitter/receiver circuit 91, which is operationally coupled to the antenna 13 and to the disable control circuit 76. The transmitter/receiver circuit 91 uses the antenna 13 to transmit and receive wireless signals that are encrypted. The encryption is effected using a suitable encryption technique of a type which is known to persons skilled in the art. The sophistication of the encryption technique can be selected to satisfy the particular application in which the equipment 12 is being used.

For example, in the disclosed embodiment, the equipment 12 is a form of military weapon, and the encryption technique would likely have a level of sophistication appropriate for a military application. On the other hand, in some other context, such as a commercial context, a known encryption technique of less sophistication would be suitable. The present invention is compatible with a wide range of encryption techniques, and it is not necessary to present the specific details of any particular encryption technique here in order to convey an understanding of the present invention.

The equipment 12 includes a tamper detection section 92, which is operatively coupled to the equipment control circuit 61, the transmitter/receiver circuit 91, and the antenna 13, and which is capable of detecting circumstances in which a person has tampered with portions of the equipment 12. In this regard, the tamper detection section 92 can perform a number of checks of the type which are known in the art and are typically used by a processor to perform a power-on self test (POST) of the circuit that contains the processor. For example, the processor may perform a checksum and/or some other type of error detection analysis on computer program code and data stored in various memories. As another example, the processor may route predetermined data through various data paths in the circuitry, and then check the resulting data to verify that it has an expected value. As still another example, the tamper detection section 92 can check the impedance and/or resistance of certain circuit elements, such as the antenna 13, in order to verify that they are present and functioning properly. Various other types of checks of the hardware and software can be carried out in order to detect the presence of tampering. In the event that the tamper detection section 92 detects tampering of any type, it uses a line 96 to supply a tamper detect signal to the disable control circuit 76.

In operation, when the equipment 12 is turned on, the tamper detection section 92 checks for any kind of tampering that it is capable of detecting, including tampering that may have taken place while power was turned off. If it detects any tampering, then it uses the line 96 to send a tamper detect signal to the disable control circuit 76. The processor 81 in the disable control circuit 76 can also check for certain types of problems. For example, if the processor 81 does not receive a valid wireless signal directed specifically to the equipment 12 at least once every three days, the processor 81 can flag the absence of a timely wireless signal as a problem to be treated the same as a determination that there has been tampering. For the moment, it is assumed for purposes of the present discussion that the tamper detection section 92 does not detect any evidence of tampering, that that equipment 81 has received at least one valid wireless signal within the last three days, and that the circuitry shown in FIG. 2 thus comes up and runs in a normal operational mode.

Assuming that the equipment 12 has not been instructed to inhibit all wireless transmissions (in a manner discussed later), then after power to the equipment 12 has been turned on, the disable control circuit 76 will cause the transmitter/receiver circuit 91 to transmit through the antenna 13 an encrypted wireless message, which includes a unique identification of the particular piece of equipment 12, and which may include other status information regarding the equipment 12, such as whether any tampering has been detected.

After that, the equipment 12 may from time to time receive through the antenna 13 an encrypted wireless message which asks the equipment 12 to transmit the wireless signal, and in response the equipment 12 will again transmit the encrypted wireless message containing its identification and status information (unless transmissions have been disabled).

If the equipment 12 is in friendly hands and is known to be in circumstances where it would be undesirable for it to transmit any wireless message, the equipment 12 can be sent an encrypted wireless message which is received through the antenna 13 and the transmitter/receiver circuit 91, and which causes the disable control circuit 76 to inhibit any further wireless transmissions through the circuit 91 and the antenna 13. The processor 81 stores in nonvolatile memory, for example at 82 or 83, an indication that wireless transmissions are currently inhibited. Then, if power for the equipment 12 is turned off and back on, the equipment 12 will remember that it has been instructed not to transmit any wireless signals. Eventually, the equipment 12 can be sent a further wireless message which is received through the antenna 13 and receiver circuit 91, and which instructs the equipment 12 that it can resume transmitting wireless messages.

Circumstances may arise in which the authority in charge of the control center 16 (FIG. 1) may decide that the equipment 12 is in the possession of an adversary or other unauthorized person and should be disabled. In that event, an encrypted wireless message can be sent to the equipment 12, and will be received through the antenna 13 and transmitter/receiver circuit 91. In response to that signal, the disable control processor 76 will use the control capability indicated diagrammatically at 86 to erase all or part of the information stored in the EEPROM 67. In the disclosed embodiment, the disable control processor 76 erases only a selected portion of the operating system 71. The processor 63 needs this selected portion of the operating system 71 in order to operate the weapons capability of the equipment 12. Therefore, by erasing this portion of the operating system 71, the equipment 12 is deprived of its capability to function as a weapon. The equipment 12 is designed so that the information erased from the EEPROM 67 is not present anywhere else in the equipment 12. Consequently, it is not possible to restore the capability of the equipment 12 to function as a weapon, unless the equipment 12 receives some form of external input, as discussed later. After erasing part or all of the EEPROM 67, the processor 81 uses the line 88 to reset the equipment control circuit 61, so that the processor 63 has to "reboot", which in turn means that the processor 63 will copy software from the EEPROM 67 to the RAM 66. As a result, the RAM 66 will end up containing the modified program from the EEPROM 67, and the missing information in this program will prevent the processor 63 from controlling the weapons capability of the equipment 12.

The immediately preceding discussion explained how the disable control circuit 76 can erase information in the EEPROM 67 in response to a wireless signal received through the antenna 13 and the circuit 91. Alternatively, in the event that the tamper detection section 92 detects any form of tampering, either at power-up or during normal operation of the equipment 12, the tamper detection section 92 sends a tamper detect signal on line 96 to the disable control circuit 76, which causes the disable control circuit 76 to in turn erase information in the EEPROM 67, in the same manner as where the disable control circuit 76 receives a disable command through the antenna 13 and the circuit 91. Moreover, if the processor 81 detects a situation in which it has not received for at least three days a valid wireless signal directed specifically to the equipment 12, the processor 81 will erase information in the EEPROM 67 in the same manner as if it had received from the tamper detection section 92 an indication that tampering had been detected.

In a situation where the disable control circuit 76 has erased a portion of the information in EEPROM 67, due to receipt of a wireless command, due to detection of tampering, or due to a determination by the processor 81 that the equipment 12 had not received a valid wireless signal for at least three days, the equipment 12 is rendered incapable as functioning as a weapon, as discussed above. In order to restore the capability of the equipment 12 to function as a weapon, a further encrypted wireless message can be sent to the equipment 12, and will be received through the antenna 13 and the transmitter/receiver circuit 91. This wireless message, or at least one subsequent related wireless message, will include encrypted replacement information equivalent to the information previously erased from the EEPROM 67. The disable control circuit 76 will then, as indicated diagrammatically at 87, reload the erased portion of the EEPROM 67 with this replacement information. One reason that the disclosed embodiment erases only a selected portion of the information in the EEPROM 67, rather than all information in the EEPROM 67, is to reduce the amount of encrypted replacement information that must be received by the equipment 12 in wireless messages in order to restore the equipment 12 to its normal operational status.

Figure 3:
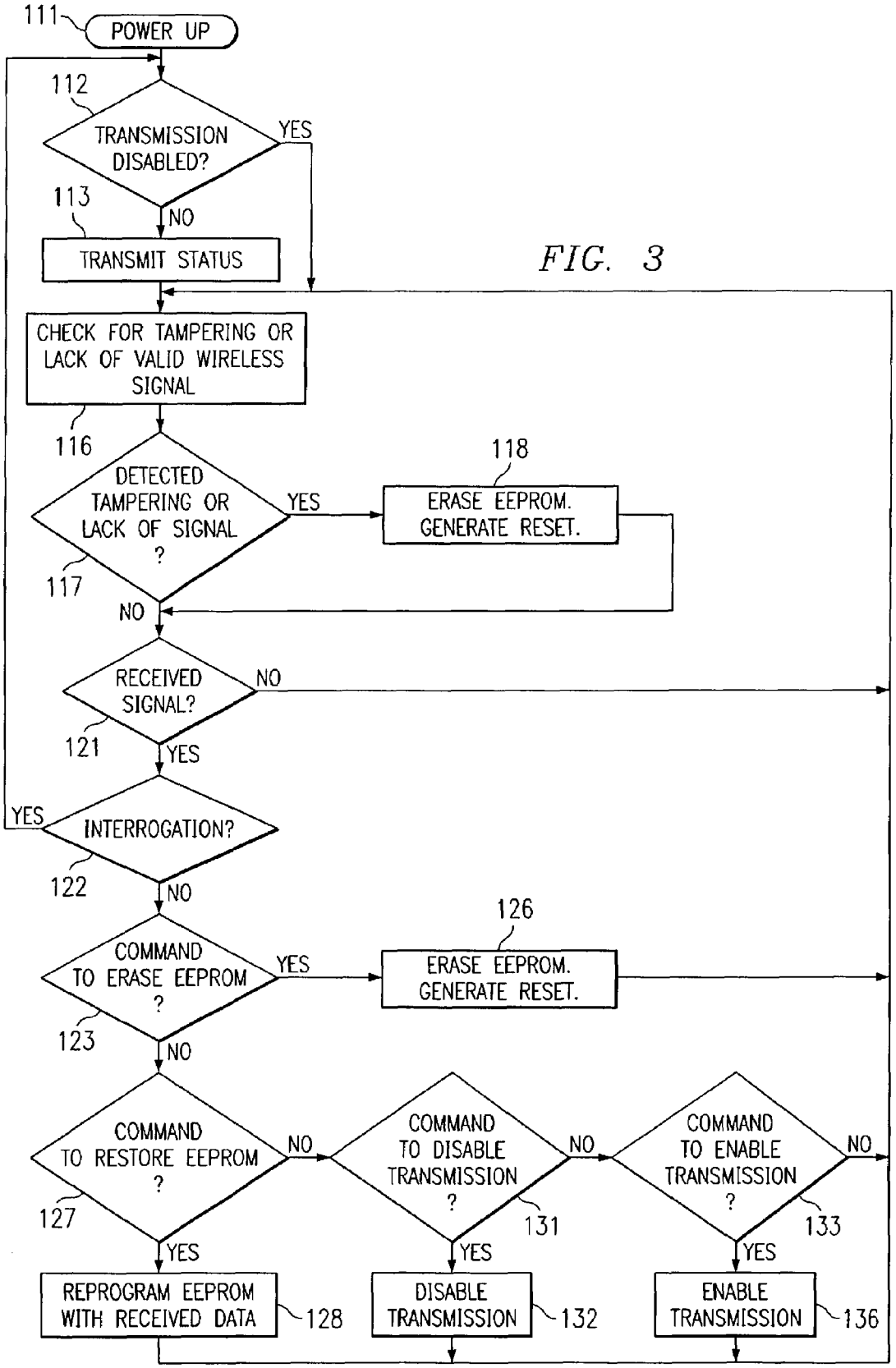
FIG. 3 is a flowchart showing a sequence of operations carried out by a processor which is a component of the item of equipment shown in FIG. 2.

FIG. 3 is a flowchart showing a sequence of operations carried out by the processor 81 of the disable control circuit 76. When power to the equipment 12 is turned on, processing starts at block 111 and proceeds to block 112. In block 112, the processor 81 checks to see whether it has previously received a command indicating that the equipment 12 is not to transmit any wireless signals. If so, then control proceeds to block 116. Otherwise, at block 113, the processor 81 transmits through the circuit 91 an encrypted wireless message which includes information such as a unique identification of the equipment 12, and status information such as whether a portion of the information in EEPROM 67 has been erased. From block 113, control proceeds to 116.

In block 116, the processor 81 and the tamper detection section 92 cooperatively check to see whether there is any evidence of tampering with relevant portions of the equipment 12. As discussed above, this could include checks of the resistance or impedance of certain portions of the hardware, diagnostic testing of certain portions of the hardware, diagnostic checks of relevant software, and so forth. In addition to checking for tampering, the processor 81 evaluates whether it has received within the last three days a valid wireless signal directed specifically to the equipment 12. Control then proceeds to block 117, where the processor 81 determines whether any tampering has been detected, or whether the processor determined that no valid wireless signal had been received within the last three days.

If no tampering has been detected, and if a valid wireless signal has been received within the last three days, then control proceeds to block 121. But if tampering has been detected, or if no valid wireless signal has been received within the last three days, control proceeds to block 118, where the processor 81 erases a selected portion of the operating system 71 stored in the EEPROM 67, and then uses the line 88 to reset the equipment control circuit 61. The reset causes the processor 63 to reboot and thus reload the RAM 66 from the EEPROM 67. As a result of the missing information in the EEPROM 67, this effectively disables the ability of the equipment control circuit 61 to cause the equipment 12 to function as a weapon, as discussed above. Moreover, as discussed above, there is nothing within the equipment 12 itself which would permit this erased portion of the operating system 71 to be regenerated. From block 118, control proceeds to block 121.

In block 121, the processor 81 checks to see if it has received any wireless signal through the antenna 13 and transmitter/receiver circuit 91. If not, then control returns to block 116. In essence, the processor 81 is in a loop, in which it waits for a wireless signal which is directed specifically to the equipment 12 and which contains encrypted information, and in which it also continuously checks for any tampering.

When a wireless signal is eventually received, control will proceed from block 121 to block 122, where the processor 81 checks whether the received wireless signal is requesting that the particular item of equipment 12 transmit an encrypted wireless signal that includes information such as a unique identification of the equipment 12, and current status information. If the received signal is such an interrogation command, control proceeds from block 122 back to block 112, so that transmission of the requested wireless signal will be effected at block 113 (unless transmissions have been disabled). On the other hand, if it is determined in block 122 that the received wireless signal is not an interrogation command, control proceeds from block 122 to block 123.

In block 123, the processor 81 checks to see whether the received wireless signal is a command instructing it to erase at least a portion of the EEPROM 67. If so, control proceeds to block 126, where at least a portion of the EEPROM 67 is erased in a manner equivalent to that described above for block 118. The processor 81 then uses the line 88 to reset the equipment control circuit 612, and the reset causes the processor 63 to reboot and thus reload the RAM 66 from the EEPROM 67. As a result of the missing information in the EEPROM 67, this effectively disables the ability of the equipment control circuit 61 to cause the equipment 12 to function as a weapon, as discussed above. Control then proceeds from block 126 back to block 116.

If it is determined at block 123 that the received wireless signal is not a command to erase part of the EEPROM 67, then control proceeds from block 123 to block 127, where the processor checks to see whether the received wireless signal is a command to restore information previously erased from the EEPROM 67. If so, then the received wireless signal, or some subsequent related wireless signals, will include replacement information that is to be loaded into the EEPROM 67 in place of the information which was previously erased. Control proceeds from block 123 to block 126, where the processor 81 reloads the erased portion of the EEPROM 67 with the replacement information, as indicated diagrammatically at 87. From block 126, control proceeds back to block 116.

If it was determined at block 127 that the received wireless signal is not a command to restore information to the EEPROM 67, then control proceeds from block 127 to block 131. In block 131, the processor 81 checks to see if a received wireless signal is a command instructing the processor 81 to inhibit all wireless transmissions from the equipment 12 until further notice. If so, then control proceeds to block 132, where the processor 81 sets a flag in a nonvolatile memory 82 or 83 in order to indicate that wireless transmissions are disabled, and then proceeds to block 116.

If it is determined at block 131 that the received wireless signal is not a command to disable wireless transmissions, then control proceeds to block 133, where the processor 81 checks to see if the received wireless signal is a command to enable wireless transmissions. If not, control proceeds to block 116. Otherwise, control proceeds to block 136, where the processor 81 resets the flag that controls the transmission of wireless signals, so that the equipment 12 is enabled to transmit wireless signals. Control then returns to block 116.

In a not-illustrated variation of the disclosed embodiment, the blocks 127 and 128 in FIG. 3 can be omitted, such that the erased portion of the EEPROM 67 cannot be restored by the technique of transmitting replacement information to the equipment 12 in the form of wireless signals. Instead, the equipment 12 would need to be returned to a factory or a service center, where technicians would restore the functionality that was disabled through erasure of part of the information in the EEPROM 67.

The present invention provides a number of technical advantages. One such technical advantage is that an authority can remotely locate and disable military or other equipment which the authority has deemed to be in unauthorized or undesirable use. A related advantage is that the disabling of the equipment can occur without the consent or knowledge of a person who currently has possession of the equipment. Still another advantage is that, once the equipment is disabled, its functionality cannot be restored without appropriate action by an appropriate authority.

Another advantage is that the location of military or other equipment can be determined in a relatively accurate manner. Still another advantage is that the present invention adds little or no significant cost to existing designs for most types of equipment. Yet another advantage is realized by provision of the capability to detect tampering with the equipment, such as tampering intended to override the disabling feature, and provision of the capability to automatically actuate the disabling feature in response to the detection of tampering. Another feature involves provision of the capability to detect a situation in which the equipment 12 had not received a valid wireless signal for a specified time interval, and provision of the capability to automatically actuate the disabling feature in response to detection of either tampering or the lack of receipt of a valid wireless signal for a predetermined time interval.

Although one embodiment has been illustrated and described in detail, it will be understood that various substitutions and alterations are possible without departing from the spirit and scope of the present invention, as defined by the following claims.

What is claimed is:

1. An apparatus, comprising a device which is capable of performing a function, and which is responsive to receipt of a predetermined wireless signal for nondestructively rendering itself incapable of thereafter performing said function except in response to the subsequent occurrence of a secure event originating externally of said device;

wherein said device includes a weapon and said function involves operation of said weapon, said predetermined wireless signal causing said device to render said weapon inoperative except in response to the subsequent occurrence of the secure event originating externally of said device;

wherein said device includes a memory that stores an operating system of the device, and performs said function in dependence on at least a portion of said operating system in said memory; and wherein said device is responsive to said wireless signal for automatically selectively erasing all or part of said operating system from said memory, said all or part of said operating system including said portion of said operating system, said device being incapable of regenerating said portion of said operating system by itself, and being incapable of performing said function without said portion of said operating system.

2. An apparatus according to claim 1, wherein said secure event includes receipt by said device of wireless information which includes replacement information that is equivalent to said portion of the operating system of the device and that said device stores in said memory, said device thereafter being capable of again performing said function in dependence on said replacement information in said memory.

3. An apparatus according to claim 2, wherein said wireless signal and said wireless information each include encrypted information.

4. An apparatus according to claim 1, wherein said device is capable of transmitting a wireless status signal which contains status information regarding said device.

5. An apparatus according to claim 4, wherein said device transmits said status signal in response to one of a power-up of said device and receipt by said device of a wireless interrogation signal.

6. An apparatus according to claim 4, wherein said device includes structure responsive to receipt of a predetermined wireless signal for thereafter inhibiting transmission by said device of wireless signals, including said status signal.

7. An apparatus according to claim 4, wherein said status signal includes information which identifies said device.

8. An apparatus according to claim 4, including structure separate from said device which is responsive to transmission by said device of said status signal for determining a current location of said device.

9. An apparatus according to claim 1, wherein said device is operable to check for indications that said device has been tampered with, and is responsive to detection of tampering for nondestructively rendering itself incapable of thereafter performing said function except in response to the subsequent occurrence of said secure event originating externally of said device.

10. An apparatus according to claim 1, wherein said device is operable to check for a lack of receipt by said device within a predetermined time interval of a valid wireless signal intended specifically for said device, and is responsive to detection of the lack of a valid wireless signal during said predetermined time interval for nondestructively rendering itself incapable of thereafter performing said function except in response to the subsequent occurrence of said secure event originating externally of said device.

11. An apparatus comprising a device which includes:

a memory that stores an operating system for the device;

a processor capable of performing a function in dependence on at least a portion of the operating system of the device;

structure responsive to receipt of a predetermined wireless signal for nondestructively rendering itself incapable of performing said function by automatically selectively erasing all or part of said operating system from said memory, said all or part of said operating system including said portion of said operating system said device being incapable of regenerating said portion of said operating system by itself, and being incapable of performing said function without said portion of said operating system; and wherein said device includes a weapon and said function involves operation of said weapon, said predetermined wireless signal causing said device to render said weapon inoperative.

12. An apparatus according to claim 11, wherein after erasing said portion of the operating system from said memory, said device is incapable of performing said function except in response to the subsequent occurrence of a secure event originating externally of said device.

13. An apparatus according to claim 12, wherein said secure event includes receipt by said device of wireless information which includes replacement information that is equivalent to said portion of the operating system and that said device stores in said memory, said device thereafter being capable of again performing said function in dependence on said replacement information in said memory.

14. An apparatus according to claim 13, wherein said wireless signal and said wireless information each include encrypted information.

15. An apparatus according to claim 11, wherein said device is capable of transmitting a wireless status signal which contains status information regarding said device.

16. An apparatus according to claim 15, wherein said device transmits said status signal in response to one of a power-up of said device and receipt by said device of a wireless interrogation signal.

17. An apparatus according to claim 15, wherein said device includes structure responsive to receipt of a predetermined wireless signal for thereafter inhibiting transmission by said device of wireless signals, including said status signal.

18. An apparatus according to claim 15, wherein said status signal includes information which identifies said device.

19. An apparatus according to claim 15, including structure separate from said device which is responsive to transmission by said device of said status signal for determining a current location of said device.

20. An apparatus according to claim 11, wherein said device is operable to check for indications that said device has been tampered with, and is responsive to detection of tampering for nondestructively rendering itself incapable of thereafter performing said function.

21. An apparatus according to claim 11, wherein said device is operable to check for a lack of receipt by said device within a predetermined time interval of a valid wireless signal intended specifically for said device, and is responsive to detection of the lack of a valid wireless signal during said predetermined time interval for nondestructively rendering itself incapable of thereafter performing said function.

22. A method of operating a device capable of performing a function, including the step of responding to receipt by said device of a predetermined wireless signal by nondestructively rendering said device incapable of thereafter performing said function except in response to the subsequent occurrence of a secure event originating externally of said device;

wherein said device includes a weapon and said function involves operation of said weapon;

wherein said step of rendering said device incapable of performing said function includes the step of rendering said weapon inoperative except in response to the subsequent occurrence of the secure event originating externally of said device;

and further comprising:

storing an operating system for the device in a memory;

performing said function in dependence on at least a portion of said operating system in said memory;

carrying out said step of rendering said device incapable of performing said function by selectively erasing all or part of said operating system said all or part of said operating system including said portion of said operating system;

preventing said device from being capable of regenerating said portion of said operating system by itself; and preventing said device from being capable of performing said function without said portion of said operating system.

23. A method according to claim 22, including the steps of:

effecting the occurrence of said secure event by transmitting to said device wireless information which includes replacement information that is equivalent to said portion of said operating system;

storing said replacement information in said memory; and causing said device to thereafter be capable of again performing said function in dependence on said replacement information in said memory.

24. A method according to claim 22, including the step of configuring said device to be capable of transmitting a wireless status signal which contains status information regarding said device.

25. A method according to claim 24, including the step of responding to receipt by said device of a predetermined wireless signal by thereafter inhibiting transmission by said device of wireless signals, including said status signal.

26. A method according to claim 25, including the steps of:

checking for indications that said device has been tampered with; and responding to detection of tampering by nondestructively rendering said device incapable of thereafter performing said function.

27. A method according to claim 25, including the steps of:

determining whether said device has received within a predetermined time interval a valid wireless signal directed specifically to said device; and responding to the lack of receipt of a valid wireless signal during said predetermined time interval by nondestructively rendering said device incapable of thereafter performing said function.

28. A method according to claim 22, including the steps of:

checking for indications that said device has been tampered with; and responding to detection of tampering by nondestructively rendering said device incapable of thereafter performing said function except in response to the subsequent occurrence of said secure event originating externally of said device.

29. A method according to claim 22, including the steps of:

determining whether said device has received during a predetermined time interval a valid wireless signal directed specifically to said device; and responding to detection of the lack of a valid wireless signal by nondestructively rendering said device incapable of thereafter performing said function except in response to the subsequent occurrence of said secure event originating externally of said device.

30. A method of operating a device which includes a processor and a memory, including the steps of:

storing an operating system for the device in said memory;

configuring said processor to be capable of performing a function in dependence on at least a portion of said operating system in said memory; and responding to receipt by said device of a predetermined wireless signal by nondestructively rendering said device incapable of performing said function, including the steps of:

selectively erasing all or part of said operating system from said memory, said all or part of said operating system including said portion of said operating system;

preventing said device from being capable of regenerating said portion of said operating system by itself;

preventing said device from being capable of performing said function without said portion of said operating system;

wherein said device includes a weapon and said function involves operation of said weapon; and wherein said step of rendering said device incapable of performing said function includes the step of rendering said weapon inoperative.

31. A method according to claim 30, wherein said step of preventing said device from being capable of performing said function is subject to the step of permitting said device to perform said function in response to the occurrence of a secure event originating externally of said device.

32. A method according to claim 31, including the steps of:

effecting the occurrence of said secure event by transmitting to said device wireless information which includes replacement information;

storing said replacement information in said memory; and causing said device to thereafter be capable of again performing said function in dependence on said replacement information in said memory.

33. A method according to claim 30, including the step of configuring said device to be capable of transmitting a wireless status signal which contains status information regarding said device.

34. A method according to claim 33 including the step of responding to receipt by said device of a predetermined wireless signal by thereafter inhibiting transmission by said device of wireless signals, including said status signal.

* * * * *